US008528797B2

(12) United States Patent
Templeton et al.

(10) Patent No.: US 8,528,797 B2
(45) Date of Patent: Sep. 10, 2013

(54) RESCUE DEVICE FOR RESCUING A CHILD

(75) Inventors: Daniel Templeton, Baldwin, NY (US); Robert J. Gold, Peoria, AZ (US)

(73) Assignee: Daniel Templeton, Baldwin, NY (US)

( * ) Notice: Subject to any disclaimer, the term of this patent is extended or adjusted under 35 U.S.C. 154(b) by 166 days.

(21) Appl. No.: 12/807,285

(22) Filed: Sep. 1, 2010

(65) Prior Publication Data

US 2012/0048899 A1 Mar. 1, 2012

(51) Int. Cl.

| | |
|---|---|
| ***A45F 4/00*** | (2006.01) |
| ***A45B 11/02*** | (2006.01) |
| ***A45C 15/00*** | (2006.01) |
| ***A61G 1/00*** | (2006.01) |

(52) U.S. Cl.

USPC ..... 224/158; 224/577; 224/186; 224/576; 224/159

(58) Field of Classification Search

USPC ..... 224/158, 577, 186, 576, 159

See application file for complete search history.

(56) References Cited

U.S. PATENT DOCUMENTS

| | | | | |
|---|---|---|---|---|
| 3,968,911 | A * | 7/1976 | Haas | 224/158 |
| 4,199,161 | A * | 4/1980 | Nieminen et al. | 280/8 |
| 4,510,634 | A * | 4/1985 | Diedrich et al. | 5/98.3 |
| 4,999,863 | A * | 3/1991 | Kane | 5/98.1 |
| 5,551,108 | A * | 9/1996 | Butler, III | 5/655 |
| 5,699,564 | A * | 12/1997 | Heh | 5/503.1 |
| 7,389,897 | B2 * | 6/2008 | Pistiolis et al. | 224/158 |
| 2009/0114691 | A1 * | 5/2009 | Bizzell et al. | 224/577 |
| 2009/0277190 | A1 * | 11/2009 | Piette | 62/56 |

* cited by examiner

*Primary Examiner* — Nathan J Newhouse
*Assistant Examiner* — Lester L Vanterpool

(57) ABSTRACT

A rescue device is disclosed for rescuing a child from a life threatening situation. The device includes a container for the reception therein of the child. A cover cooperates with the container such that when the child has been placed within the container, the container and the cover cooperate together to define a safe enclosure for the evacuation of the child from the life threatening situation.

17 Claims, 12 Drawing Sheets

RESCUE DEVICE FOR RESCUING A CHILD

BACKGROUND OF THE INVENTION

1. Field of the Invention

The present invention relates to a rescue device.

More specifically, the present invention relates to a rescue device for rescuing a child from a life threatening situation.

2. Background Information 5,712 children under the age of 5 died as a result of residential fires between 1989 and 1998 in the United States alone.

When an emergency breaks out, a child or toddler must be carried by the parent, first responder or other rescuer to a place of safety. Often, such rescue operation must be carried out in a smoke filled house or with flames rapidly engulfing the house. On many rescue missions, it is difficult to locate the child because of thick smoke. Also, once the child has been located, because the child must be held in the arms of the rescuer, the arms of the rescuer are not free to open doors or windows to rapidly evacuate the child from the potentially lethal situation.

The present invention seeks to overcome the aforementioned problems by the provision of a fire resistant and heat mitigating device for the transport of the child so that when the child is located, the child may be safely secured within the rescue device. The rescue device according to the present invention, with the child inside can then be rapidly transported to a point of safety.

Additionally, the rescue device includes audible and visual alarms to alert rescue personnel regarding the precise location of the child being rescued Furthermore, the rescue device includes various handles and straps for carrying and maneuvering the device to facilitate the rapid evacuation of the child from the life threatening environment.

Also, the present invention includes a rope which enables the rescuer to lower the rescue device with the child therein from an upstairs window to a point of safety suspended outside and below the window or on the ground.

Moreover, runners, casters or other low friction surfaces on the bottom of the rescue device enable the rescue device to roll or slide down a sloping roof while the rescuer controls the lowering of the rescue device with the child inside by means of the rope, or allows the rescuer to slide the rescue device along a floor or other surface while escaping from the life threatening environment.

Therefore, the primary feature of the present invention is the provision of a rescue device that overcomes the problems associated with the prior art rescue means and makes a significant contribution to the life saving and rescuing art.

A further feature of the present invention is the provision of a rescue device which is easily stored under or in the proximity of the baby's crib, or in a nearby closet.

A further feature of the present invention is the provision for a low cost rescue device capable of rescuing a child from an emergency situation which could be any number of natural or man-made situations.

Also, the present invention provides a device having a fire resistant exterior covering for protecting the entire contents of the device from flame and ignition and provides a primary thermal mitigation layer. The thermal protective layer is capable of slowing and mitigating the transfer of high heat levels from the exterior of the device to the inside compartment of the device.

The device also provides an impact layer or shell of a hard material around the majority of the device in order to spread an impact over a larger area and to stop penetration of low to medium force impact flying debris.

Additionally, the device includes an exterior set of runners or castors or a rounded surface, all of which provide a low friction resistance so that the device can be more easily pushed on surfaces such as floors or down slanted roof shingles when carrying the device is not an option.

The padded inner transport cavity of the device provides a means for securely holding a child inside the unit and is capable of restraining movement caused by the child or the motion of the device while in transport.

The padded inner transport cavity of the device provides a means for securely holding a child inside the unit to support the fragile body of a newborn or infant.

Also, the webbing of the device provides a system capable being in contact with the child being transported so as to restrain the movement caused by the child or mitigate motion of the child in the device due to the motion of the device while in transport.

Also, the webbing of the device provides a secondary protective impact and thermal barrier created by the air gap around the child being transported.

A simple load/close operational mode of the device provides an intuitive sealing and locking procedure capable of being performed by feel without the need for looking at the device.

A self-actuating internal system which utilizes the physical format of the closing of the unit is provided in order to place the restraining web system around the child being transported.

An integral emergency resistant rope is secured to a central harness which is an integral structure of the device in order to provide an arrangement stored within the device. The rope is retrievable from its storage compartment and remains connected to the device for providing a means for lowering the device. More specifically, the rope is extendable via two methods [1] by hand and [2] by a simple rope friction control flow device such as a belay which is provided in order to allow the stored rope to lower the device at a controlled rate and to provide a means for locking the rope at a specific length if needed. By squeezing the belay, the arrangement provides a means for permitting the flow of rope. When the belay is released, the flow of the rope is stopped similar to a dead man switch type function thus preventing the lowering of the device to the ground too quickly.

The rope with or without the use of the belay, provides a means of lowering the device from a window or other upper story location so that the device can be safely transported to the ground. The rope has an integral locking ring or caribiner at the non-attached end of the rope for securing the rope to a fixed structure to allow the use of the rope as an escape device for the rescuer. The ring also provides means for securing a secondary rope extension to the primary rope to lengthen the distance the device can be lowered.

A carry sling and handles provide a rescuer with the means to carry the device hands free by placing the sling over a shoulder or around the neck, or with one hand or on the side, or back or the front of the body of the rescuer.

Such handles are secured to the device and the integral internal support harness. Grip handles are provided on the top, front, back and all sides of the device thus providing ample means for holding the device.

An air and ventilation system including a filter system is an option that allows air to be forced through the device to create a positive internal pressure within the device to help keep smoke out of device. One method of ventilation uses a hand pumped air system to force exterior air into the filter and into an interior cavity of the device to supply internal positive pressure and adjunct supply of breathable air to the child. Alternatively, another system can use the rescuers breathing through a tube to force clean filtered air across the baby, then to the rescuer as a system where the rescuer and the baby share fresh air brought into and through the safe enclosure via the breathing of filtered outside air by the rescuer. In the preferred embodiment of the invention the forced air system uses a powered electric mini-fan, which is activated together with the lighting system. All possible ventilation systems mentioned force outside air through the filter to provide both positive pressure and air for breathing.

A lighting system is provided such as an external strobe on the bottom of the device to make the device very visible when in a smoke filled environment. The strobe light is provided to attract attention to the device being lowered to the ground from an upper story window. Also, LEDs on the exterior of the device include both flashing and constant lighting for providing light in a smoke filled environment and for making the device visible to rescuers. An internal light is provided in order to illuminate the interior of the device and to calm the child while inside the device. All of the lights are battery operated with a battery system in a stand-by mode using an interference fit insulator. When the insulator is pulled out by the activation of one or more of the device features or by the removal of the device from its storage case 202, the battery becomes electrically connected to the circuit and activates all of the lights and if provided, the powered air fan system.

A sound system provides an audible alarm when the device is activated. The sound system provides a distinct sound which is different from Fire Department "PASS" alarms which activate when a fire fighter is not moving for more than 20 seconds. The alarm according to the present invention sounds continuously until the device is opened and the child is removed.

Other features and advantages of the present invention will be readily apparent to those skilled in the art by a consideration of the detailed description of a preferred embodiment of the present invention contained herein.

SUMMARY OF THE INVENTION

The present invention relates to a rescue device for rescuing a child from a life threatening situation. The device includes a container for the reception therein of the child. A cover cooperates with the container such that when the child has been placed within the container, the container and the cover define a safe enclosure for the evacuation of the child from the life threatening situation.

In a more specific embodiment of the present invention, the container is of a shape that is consistant with holding the size and shape of a small child within its interior.

Preferably, the container is fabricated from a material which is fire resistant, padded and impact resistant.

The container includes a base of generally rectangular configuration. The base has an inner and an outer surface. Also, the base has a first and a second end and a first and a second side. The ends and the sides of the base define a peripheral edge.

A wall has an inner face and an outer face and a first and a second side. The first side of the wall has a first length which is equal to a second length of the peripheral edge of the base. The first side of the wall and the peripheral edge of the base are joined together such that the wall extends away from the base with the second side of the wall being spaced from the base.

Moreover, the exterior of the container includes a plurality of push/pull grips which extend outwardly around the wall. The grips are disposed between the sides of the wall such that during the evacuation of the child, the grips permit pushing and pulling of the container when the child is within the safe enclosure.

Furthermore, the container includes a single large runner or a plurality of smaller runners that are secured to the base. The arrangement is such that during the evacuation of the child, the runners permit the container to slide along a surface contacted by the runners to facilitate rapid evacuation of the child from the life threatening situation.

Additionally, the container includes an integral emergency fire resistant shoulder carry strap and a pull handle. The carry strap and the pull handle both extend from the outer face of the wall.

Also, the container defines a compartment and an alarm system is housed within the compartment. The alarm system includes a battery.

An audio alarm emmitter is operably connected to the battery such that during the evacuation of the child, the audio alarm emmitter provides an audible indication of the location of the rescue device and the child inside the device.

Furthermore, a visual alarm arrangement is operably connected to the battery. A plurality of lights is disposed over the outer surface of the base and the outer face of the wall. The lights are operably connected to the visual alarm arrangement such that during the evacuation of the child, the lights provide a visual indication of the location of the rescue device.

A fan is energized by the battery for generating a flow of air into the safe enclosure.

Also, a filter is disposed within the flow of air for filtering the flow of air flowing into the safe enclosure.

Moreover, a lamp is operably connected to the battery so that, when the child is placed within the safe enclosure, such safe enclosure is illuminated by the lamp in order to comfort the child during the evacuation of the child from the life threatening situation. The lamp also illuminates the safe enclosure in order to assist placement of the child on the web suspension.

Additionally, the container defines a further compartment. Within the compartment, a rope has a first and a second end, the first end of the rope being secured to the container.

A belay system is secured to the rope between the first and second ends thereof. The arrangement is such that in a first disposition of the rope, the rope and the belay system are stored within the further compartment. However, in a second disposition of the rope, during the evacuation of the child, the rope and the belay system are removed from the further compartment. The belay system cooperates with the rope for permitting a controlled lowering of the rescue device with the child disposed within the safe enclosure so that the child is lowered from the life threatening situation to a safe location.

Furthermore, the cover is of clam shell type configuration.

More specifically, the cover includes a first portion which defines a periphery. The periphery has a first and a second end.

A second portion defines a further periphery. The further periphery has a first and a second extremity. The arrangement is such that the first and second portions pivot relative to each other about an axis which extends through the ends and the extremities of the periphery and further periphery respectively. Therefore, in a first disposition of the portions, placement of the child within the safe enclosure is permitted. However, in a second disposition of the portions, the portions are pivotted relative to and towards each other for enclosing the child within the safe enclosure so that evacuation of the child from the life threatening situation is permitted.

Additionally, the first portion includes a carry handle which extends from the periphery.

Also, the second portion includes a further carry handle which extends from the further periphery such that when the portions are in the second disposition thereof, the carry handles cooperate with each other so that carrying the rescue device is permitted.

A web suspension is secured to the periphery and the further periphery of the portions. The arrangement is such that when the portions are in the first disposition thereof, placement of the child on the web suspension is permitted. However, when the portions are pivotted to the second disposition of the portions, the child is safely and securely restrained within the safe enclosure by the web suspension system during evacuation of the child from the life threatening situation.

The rescue device is stored adjacent to or under the babies crib so that the rescue device is readily available to be retrieved from its storage case 202 for immediate use during the life threatening situation Many modifications and variations of the present invention will be readily apparent to those skilled in the art by a consideration of the detailed description contained hereinafter taken in conjunction with the annexed drawings which show a preferred embodiment of the present invention. However, such modifications and variations fall within the spirit and scope of the present invention as defined by the appended claims.

Included in such modifications is an arrangement in which the cover is of one piece construction and is pivotally connected to the container so that when the cover is pivotted to a closed disposition relative to the container, the cover and container define the safe enclosure.

Additionally, although the drawings of the preferred embodiment show a generally rectangular shaped device, the device can be of any shape that would define a safe enclose therein.

Also, although the container in the preferred embodiment is shown as including a base and upstanding walls, the container could be of a one piece construction and forms a safe enclosure by the rolling or folding of the one-piece construction

BRIEF DESCRIPTION OF THE DRAWINGS

Similar reference characters refer to similar parts throughout the various views of the drawings.

DETAILED DESCRIPTION OF THE DRAWINGS

Figure 1:
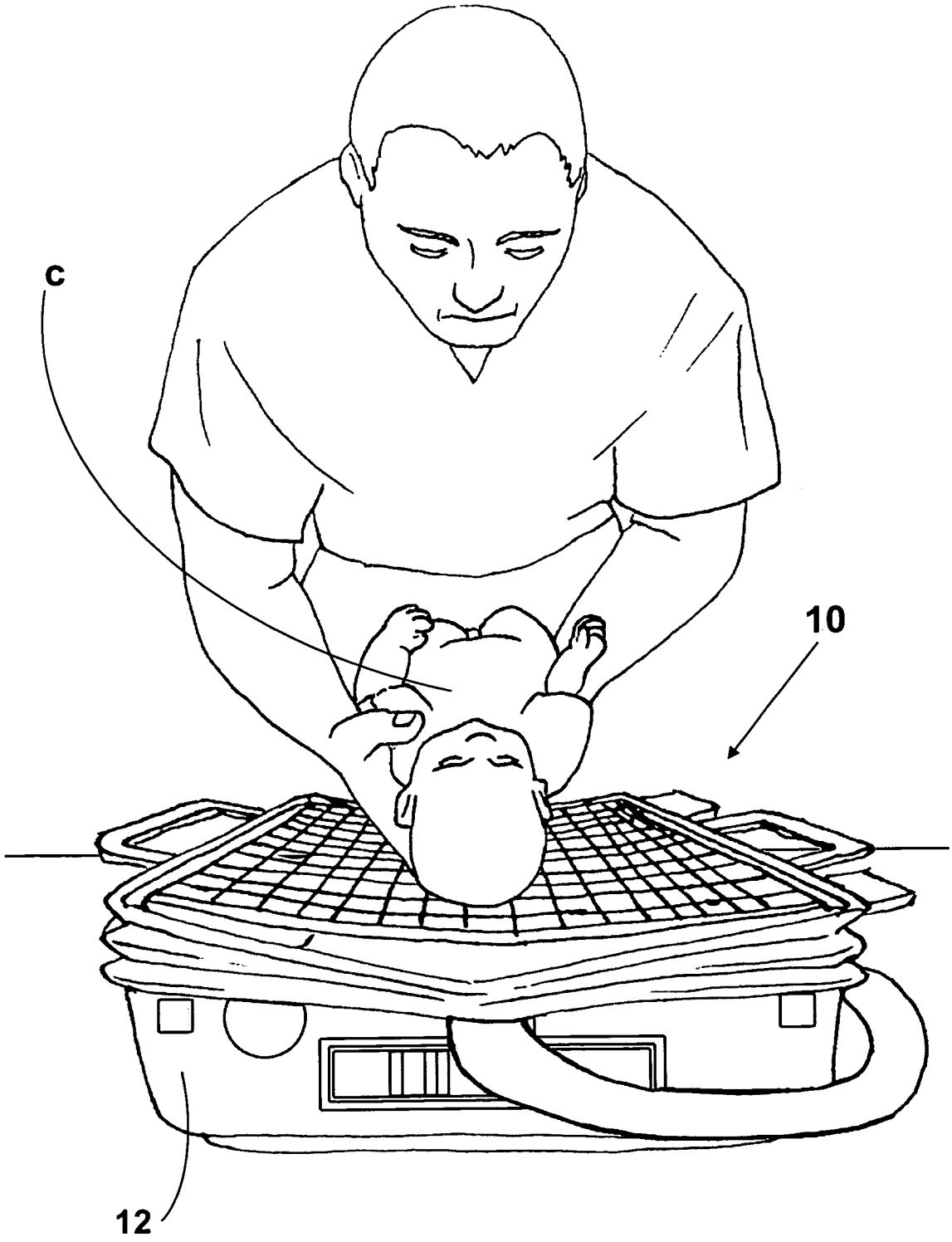
FIG. 1 is a perspective view of a rescuer placing a child onto the web suspension of the rescue device according to the present invention for rescuing a child from a life threatening situation.

FIG. 1 is a perspective view of a rescue device generally designated 10 for rescuing a child C from a life threatening situation. As shown in FIG. 1, the device 10 includes a container generally designated 12 for the reception therein of the child C.

Figure 2:
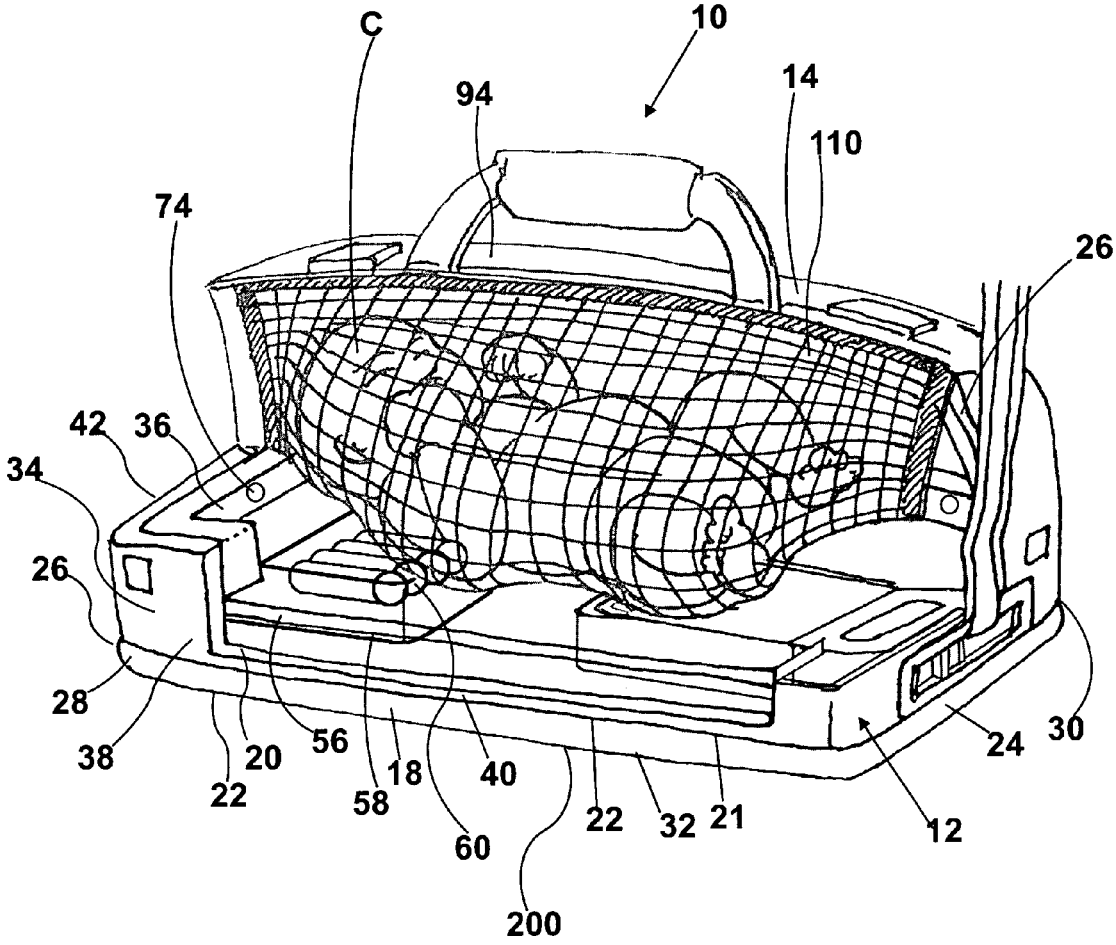
FIG. 2 is a perspective view partially in section of the rescue device with the child securely held within the web suspension system shown in FIG. 1.

FIG. 2 is a perspective view partially in section of the rescue device 10 shown in FIG. 1. As shown in FIG. 2, a cover generally designated 14 cooperates with the container 12. The arrangement is such that when the child C has been placed within the container 12, the container 12 and the cover 14 cooperate together to define a safe enclosure 16 for the evacuation of the child C from the life threatening situation.

The term "child" throughout the specification is to be understood as including infants from birth to 3 years of age. The term "child" also includes domestic pets that may need to be rescued.

Also, the term "life threatening situation" as used throughout the present application is to be understood as including a residential or other type of emergency situation such as a fire, flood situation, an earthquake related disaster, a or any other type of disaster situation, both natural or man made.

Also, as shown in FIGS. 1 and 2, the container 12 is of generally rectangular configuration.

Preferably, the container 12 is fabricated from a material which is fire resistant, padded and impact resistant.

As shown in FIG. 2, the container 12 includes a base 18 of generally rectangular configuration. The base 18 has an inner surface 20 and an outer surface 22. Also, the base 18 has a first end 24 and a second end 26 and a first side 28 and a second side 30. The ends 24, 26 and the sides 28, 30 of the base 18 define a peripheral edge 32.

The container 12 also includes a wall 34. The wall 34 has an inner face 36 and an outer face 38 and a first side 40 and a second side 42. The first side 40 of the wall 34 has a first peripheral length L1 which is equal to a second length L2 of the peripheral edge 32. The first side 40 of the wall 34 and the peripheral edge 32 are joined together such that the wall 34 extends away from the base 18 with the second side 42 of the wall 34 being spaced from the base 18. Those skilled in the art will appreciate that the base 18 and the wall 34 could alternatively be molded as a single one piece unit.

As shown in FIG. 2, the container 12 defines a compartment 56. An alarm system generally designated 58 is housed within the compartment 56.

Figure 3:
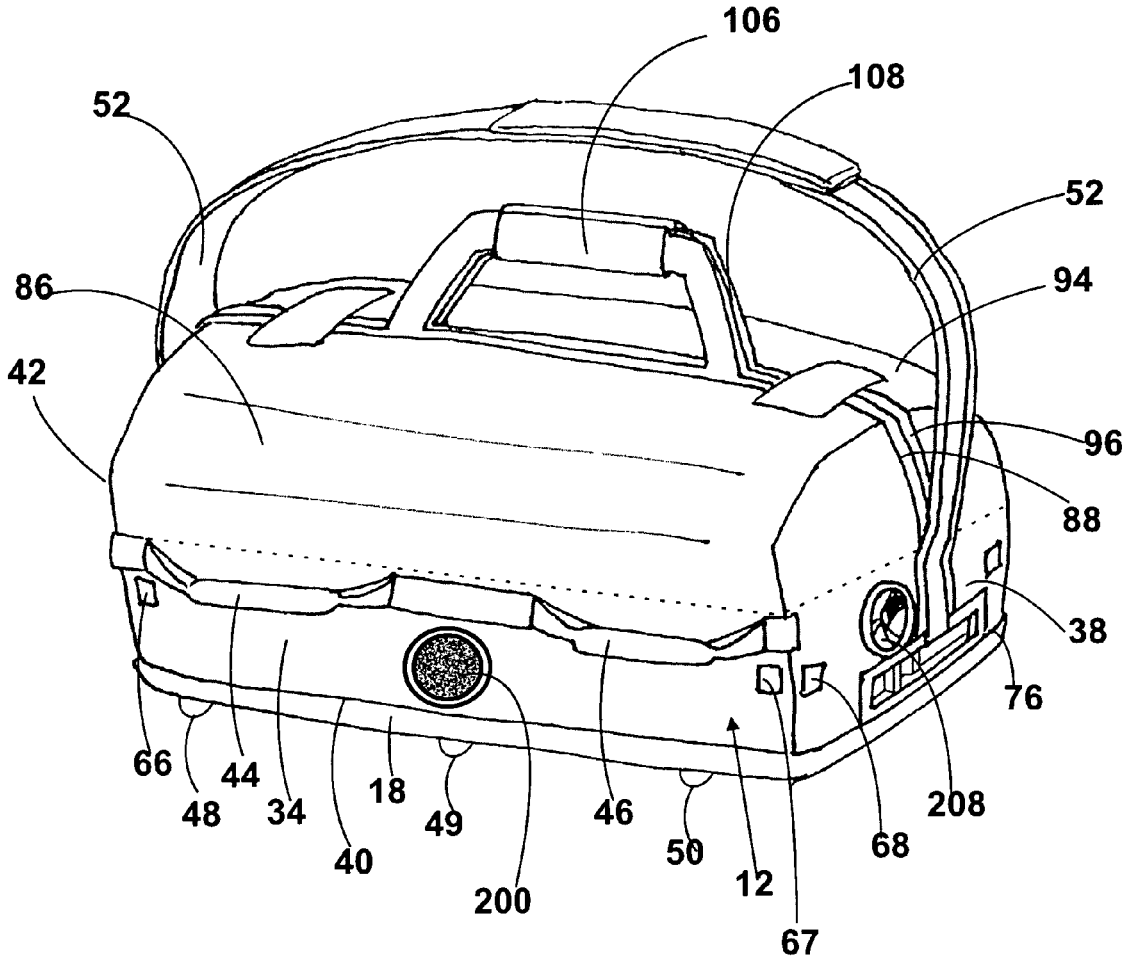
FIG. 3 is a similar view to that shown in FIG. 2 but shows further features of the exterior of the rescue device.

FIG. 3 is a similar view to that shown in FIG. 2 but shows further features of the container 12. As shown in FIG. 3, the container 12 includes a plurality of push/pull grips 44 and, 45 which extend around the wall 34. The grips 44-45 are disposed between the sides 40, 42 of the wall 34 such that during the evacuation of the child C, the grips 44-45 permit pushing and pulling of the container 12 when the child C is within the safe enclosure 16.

As shown in FIG. 3, the container 12 includes a plurality of runners 48, 49 and 50 that are secured to the base 18. The arrangement is such that during the evacuation of the child C, the runners 48-50 permit the container 12 to slide along a surface S contacted by the runners 48-50 to facilitate rapid evacuation of the child C from the life threatening situation.

Additionally, the container 12 includes an integral fire resistant shoulder carry strap 52

FIG. 3 shows the carry strap 52 extending from the outer face 38 of the wall 34. As shown in FIG. 2, the container 12 defines a compartment 56. An alarm system generally designated 58 is housed within the compartment 56.

Figure 4:
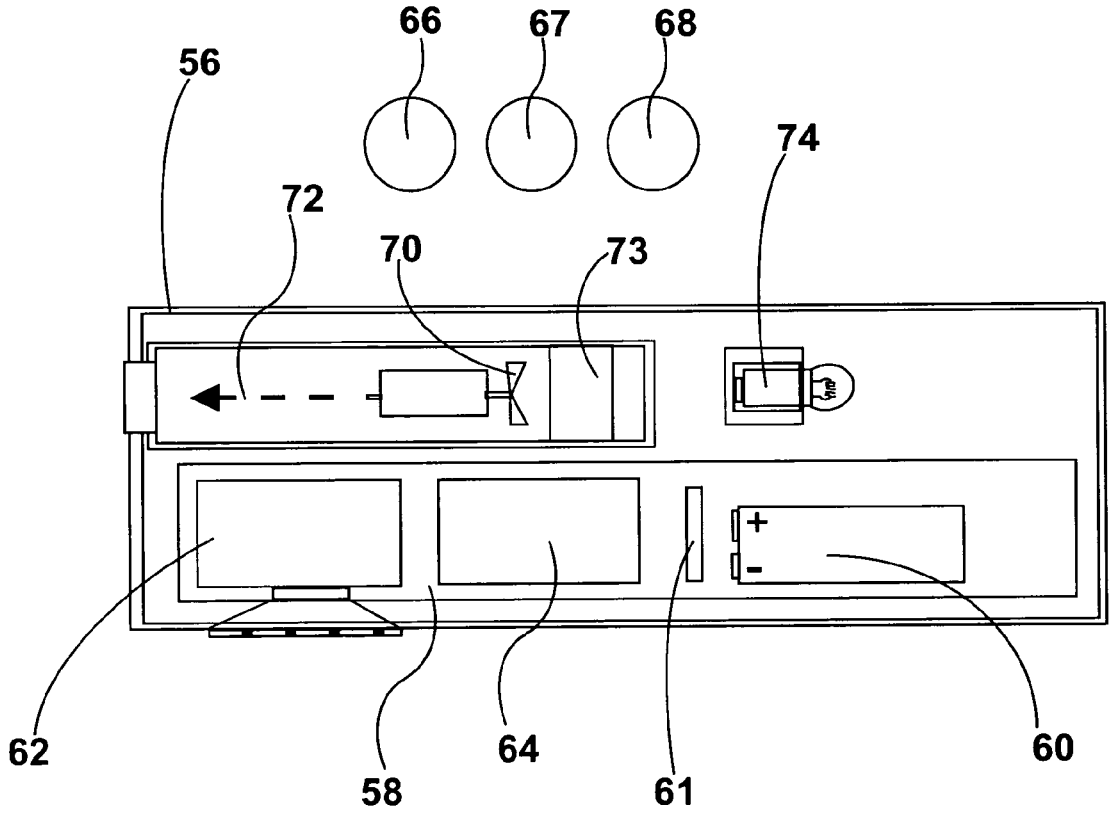
FIG. 4 is a schematic view of the electrical components compartment shown in FIG. 2.

FIG. 4 is a schematic view of the compartment 56 shown in FIG. 2. As shown in FIG. 4, the compartment 56 houses the alarm system 58. The alarm system 58 includes an electrical battery 60.

The battery 60, because it must wait for an extended period of time before being used, must have a "system disconnect" where the actual terminals are not in contact with the circuitry of the device. This will prevent possible drainage of the power of the battery and will prevent a dead battery when it is needed. This disconnect is a simple interference fit non-conductor 61 placed within the electronics at the battery connection point. This non-conductor 61 will be attached to the cover 14 in a manner which will cause the nonconductor 61 to be pulled out of the way from the electrical connector and battery contact causing the electronics to activate the light and sound functions. This simple and straightforward "switch" to activate the alert systems when the device is put into use, also, provides an insulation effect to keep power at its highest use state when in the standby mode.

The invention can be trial tested by a purchaser and then re-stored with the energy interrupting non-conductor 61 back in place with the lights and sound off, and the battery at its lowest possible level of discharge.

An audio alarm circuit 62 is operably connected to the battery 60 such that, during the evacuation of the child C, the audio alarm circuit 62 provides an audible indication of the location of the rescue device 10 via a speaker 200 on the exterior surface 34.

Furthermore, a visual alarm circuitry 64 is operably connected to the battery 60.

As shown in FIG. 3, a plurality of lights 66, 67 and 68 is disposed over the outer surface 22 of the base 18 and the outer face 38 of the wall 34. The lights 66 to 68 are operably connected to the visual alarm arrangement 64 such that, during the evacuation of the child C, the lights 66 to 68 provide a visual indication of the location of the rescue device 10

As shown in FIG. 4, a fan 70 is energized by the battery 60 for generating a flow of air, as indicated by the arrow 72, into the safe enclosure 16.

Also, a filter 73 is disposed within the flow of air 72 for filtering the flow of air 72 flowing into the safe enclosure 16. The fan 70 and filter 73 are an optional feature of the present invention. In many rescue operations, the rescue is so quick that the air within the device will be sufficient to accomplish the rescue operation.

Moreover, a lamp 74 is operably connected to the battery 60 so that, when the child C is placed within the safe enclosure 16, such safe enclosure 16 is illuminated by the lamp 74 in order to comfort the child C during the evacuation of the child C from the life threatening situation. The provision of the lamp 74 makes a significant contribution to the well being of the child so that the child experiences the least psychological trauma during the rescue scenario.

The lamp 74 although shown in the electronics box in FIG. 4, is in fact located inside the safe enclosure 16 as shown in FIG. 2 so as to illuminate the child C. The box for the electronics is located at the bottom of the device and may be an actual box or a harder foam layer within which the electrical components will be housed and will be under a protective soft insulation layer which is disposed under the web suspension system. A simple micro switch held in an "off" position when the device is within its storage case 202 will activate the lamp circuit to illuminate the child when the device is removed from the storage case 202. As soon as the device 10 is removed from the storage case, the lamp 74 is activated and illuminates the child reception area to help place the child in the proper place if the rescuer is in the dark. The interior illumination lamp 74 is activated from the moment the device is removed from the storage case 202 and will stay on until a pre-set time after the cover is opened allowing an easy visual identification and removal of the child when the device cover 14 is opened.

As shown in FIG. 3, the container 12 defines a further compartment 76.

Figure 5:
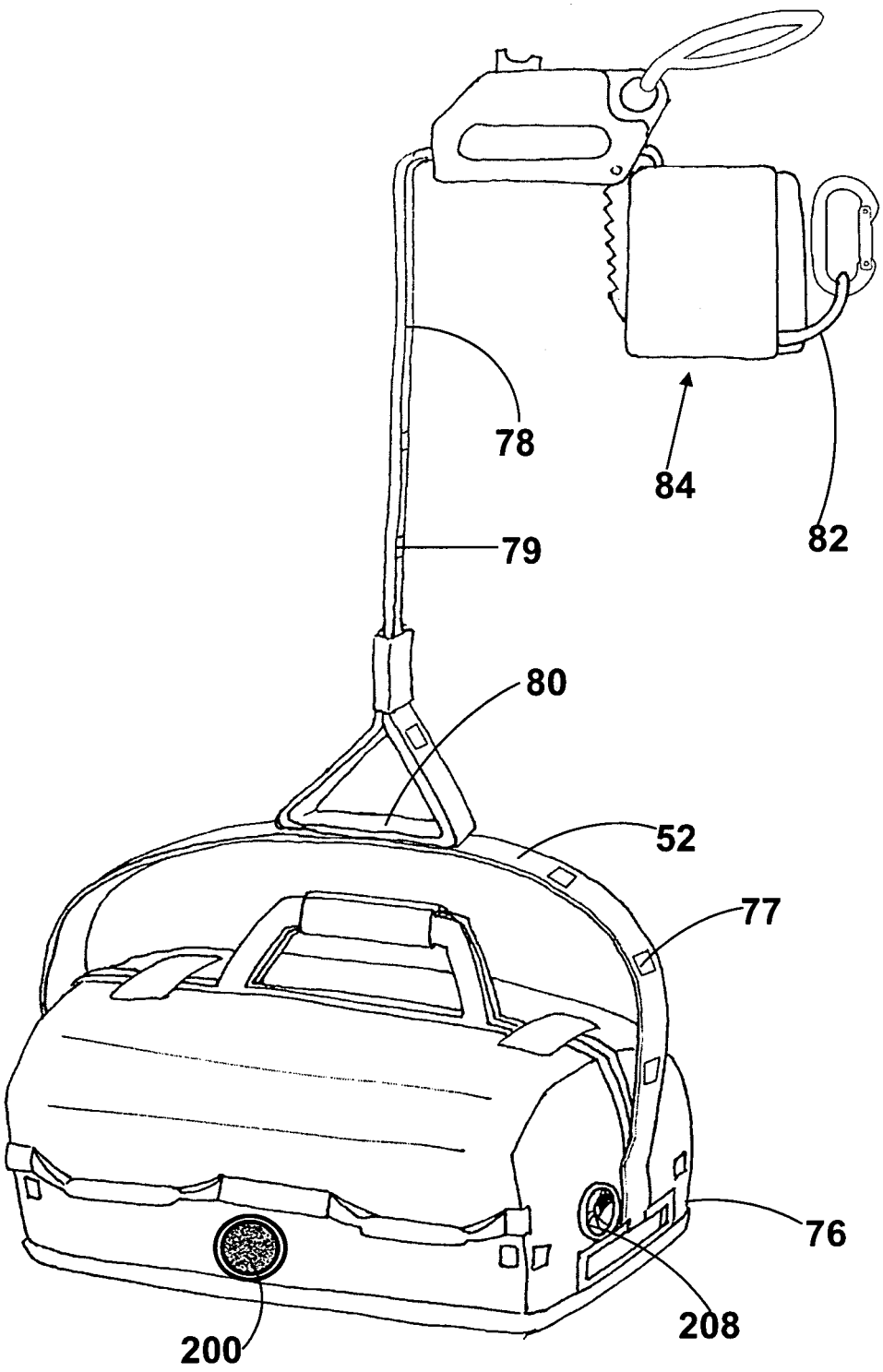
FIG. 5 is a similar view to that shown in FIG. 3 but on a reduced scale and which shows the belay rope system in a deployed position.

FIG. 5 is a similar view of the device 10 that is shown in FIG. 3 but on a reduced scale and showing the deployment of the rope 78 lowering system. As shown in FIG. 5, a rope 78 which is initially stored in the further compartment 76 is removed from the further compartment 76 as shown in FIG. 5. The rope 78 is permanently secured to the integral fire resistant shoulder carry strap 52. When stored, the rope 78 is releasably fastened to the strap 52 by cooperating VELCRO tabs 77 and 79 and the rest of the rope 78 is disposed within the further compartment 76. The rope 78 has a first end 80 and a second end 82. The first end 80 of the rope 78 is secured to the container 12 by means of the strap 52.

A belay system generally designated 84 is secured to the rope 78 between the first end 80 and the second end 82 thereof. The arrangement is such that in a first disposition of the rope 78, the rope 78 and the belay system 84 are stored within the further compartment 76 as shown in FIG. 3.

Figure 5A:
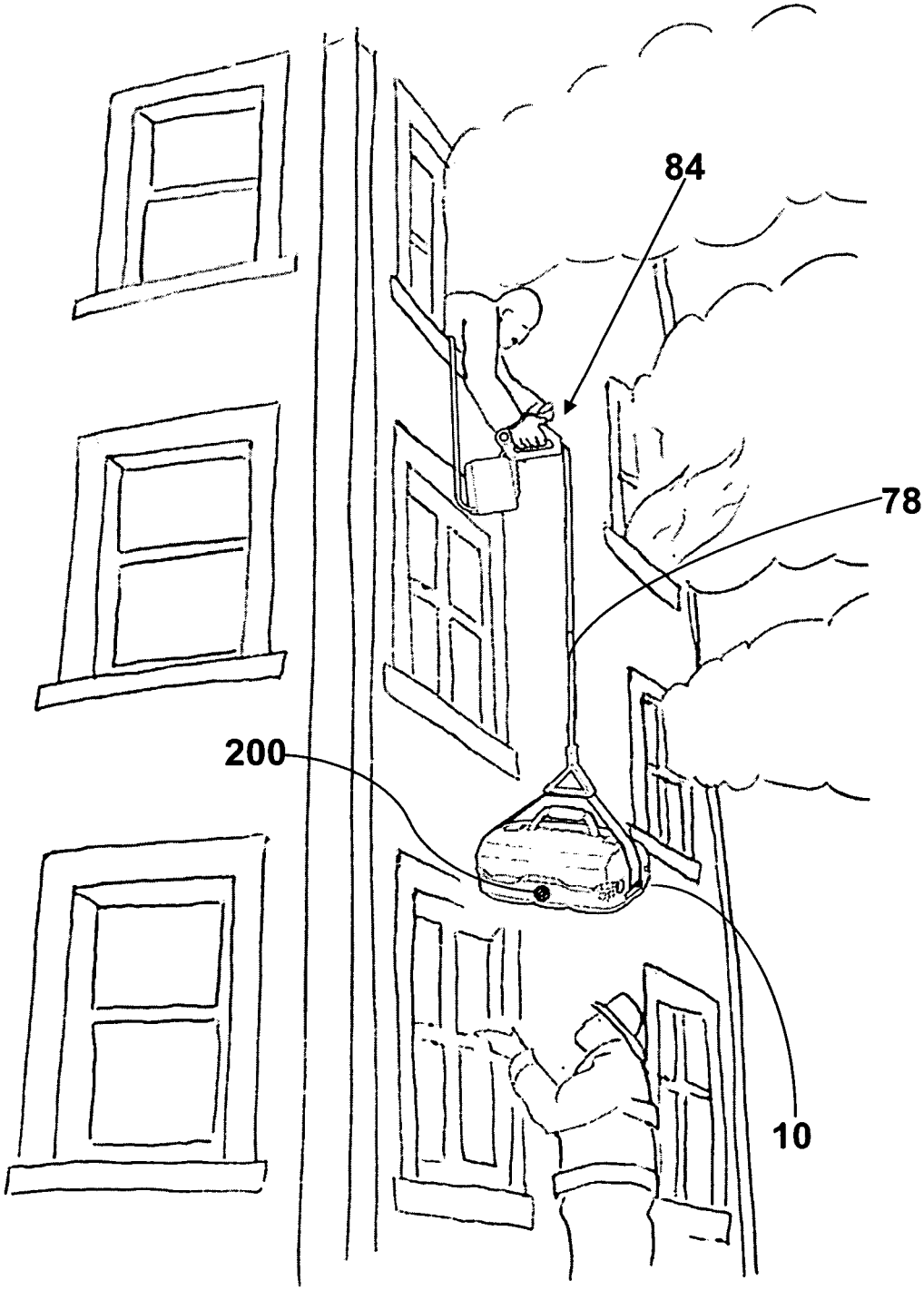
FIG. 5A is a perspective view of the rescue device according to the present invention being lowered from a window utilizing the belay rope system.

FIG. 5A is a perspective view of the rescue device 10 being lowered from a window. As shown in FIG. 5A, in a second disposition of the rope 78, during the evacuation of the child C, the rope 78 and the belay system 84 are removed from the further compartment 76. The belay system 84 cooperates with the rope 78 for permitting a controlled lowering of the rescue device 10 with the child C disposed within the safe enclosure 16 so that the child C is lowered from the life threatening situation to a safe location.

Figure 5B:
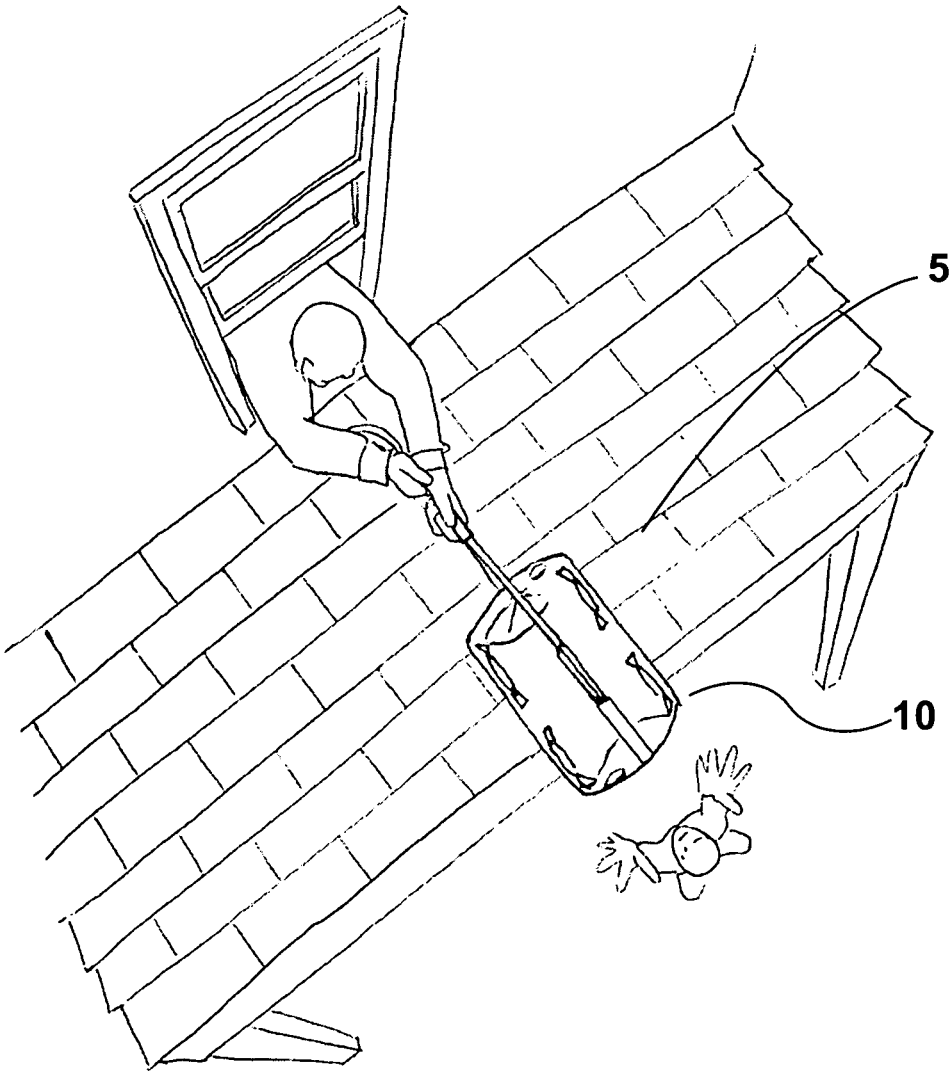
FIG. 5B is a perspective view of the rescue device being lowered by a rescuer utilizing hands on the rope without the belay system and being from a window which is not located immediately above a point of safety.

FIG. 5B is a perspective view of the rescue device 10 being lowered from a window which is not located immediately above a point of safety. In this case, as shown the rescuer is not utilizing the belay system 84 and instead uses his hands to lower the rope 78 and allows the rescue device 10 to slide over the surface S of the roof by means of the runners 48-49 until the rescue device 10 is able to be lowered vertically to the point of safety below.

Figure 5C:
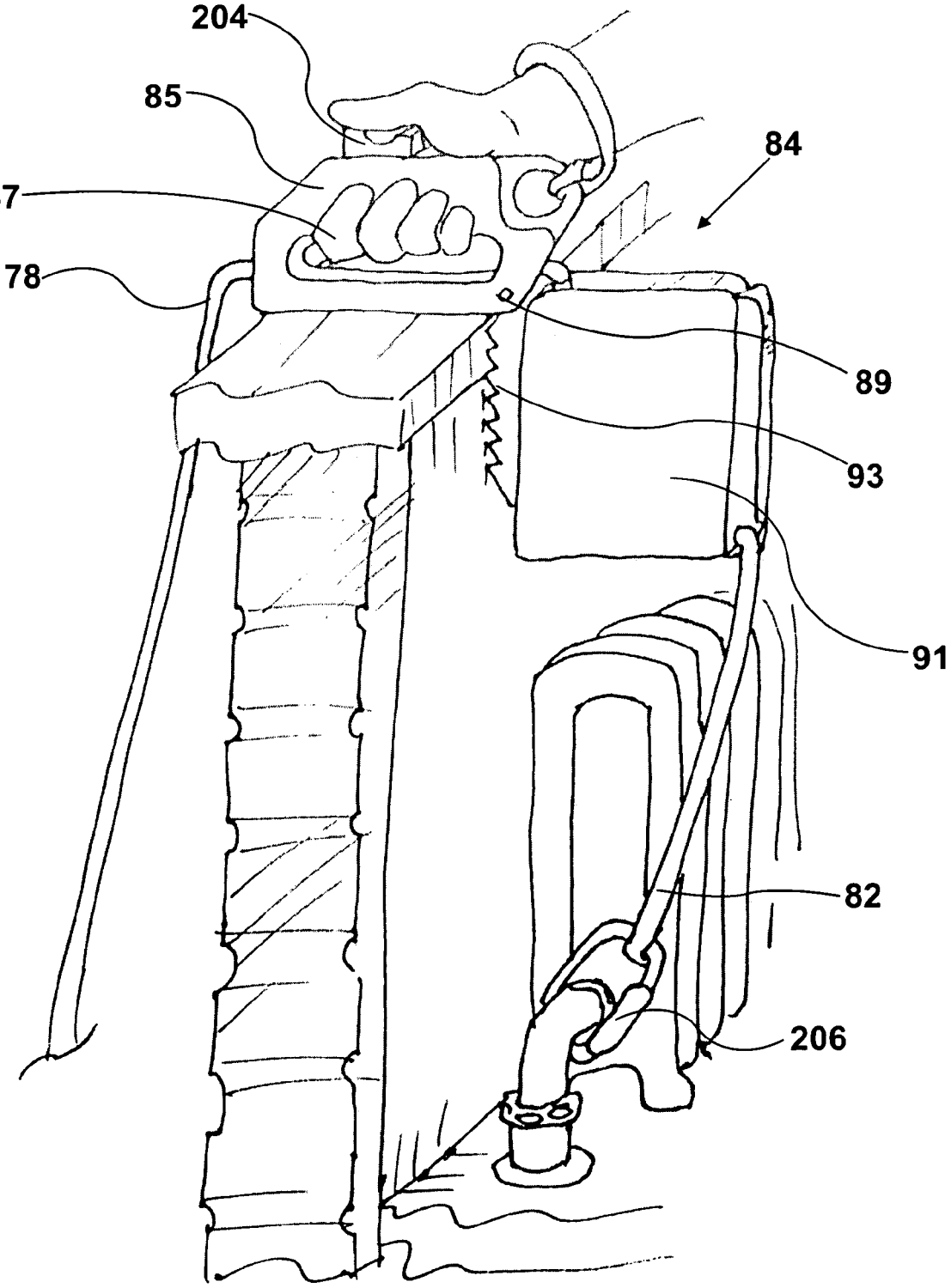
FIG. 5C is a perspective view of the belay system for the controlled flow therethrough of the fire resistant rope.

FIG. 5C is a perspective view of the belay system 84 for the controlled flow therethrough of the fire resistant rope 78. As shown in FIG. 5C, the belay system 84 includes a casing 85. A hand grip 87 is integral to the casing 85 so that the hand grip 87 places the rescuer's hand in a position to securely hold belay casing 85 in a manner which allows the operation of the rope control 204 which allows the release of rope 78 or controllably locks the rope 78, or adjusts the speed of rope 78 as the rope controllably slides through the casing 85. Additionally, belay casing 85 is pivotally secured at point 89 to a box 91 which stores a sufficient length of the rope 78 to enable the controlled lowering of the device 10 to safety. As shown in FIG. 5C, the box 91 includes a jagged edge 93 so that the belay 84 can be secured to the window sill. Also, the second end 82 of the rope 78 includes a fastener 206 for fastening the rope 78 to a fixture such as the radiator thereby permitting the rescuer to escape by climbing down the rope 78.

Figure 6:
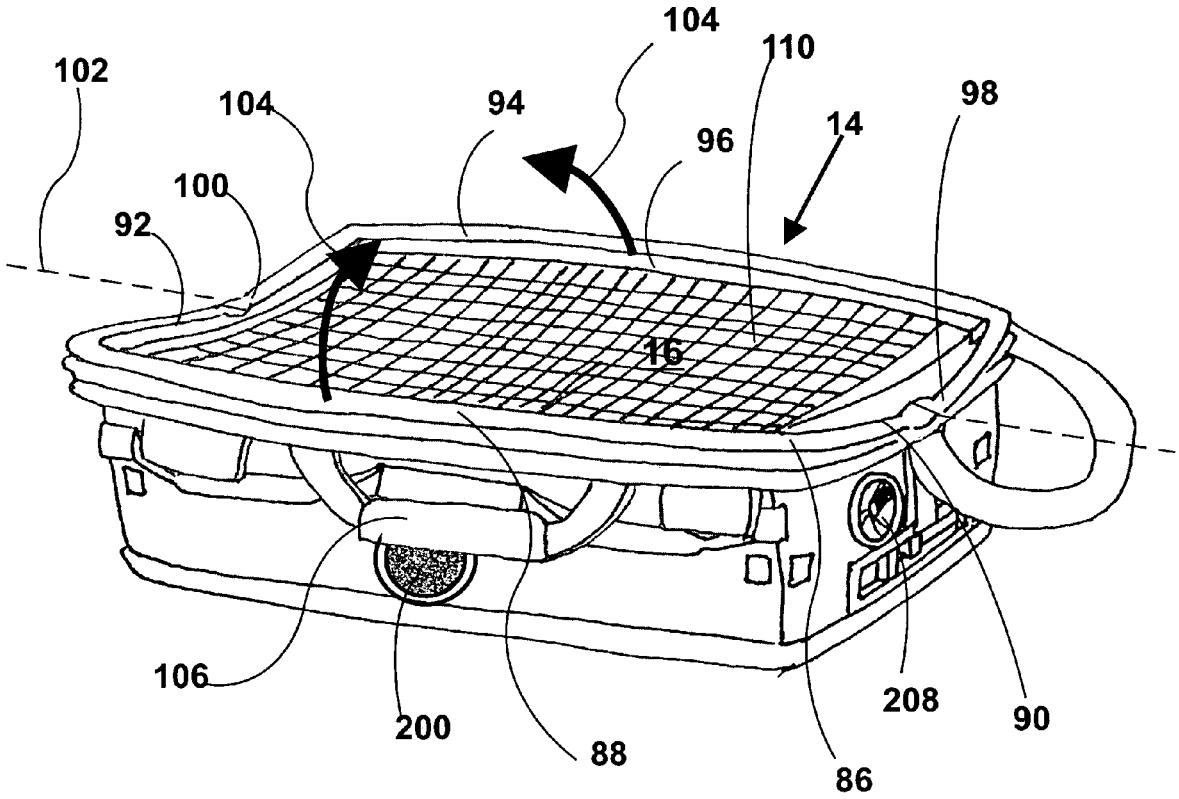
FIG. 6 is a perspective view of the rescue device shown in FIGS. 1-5 in an open format as it will be when removed from its storage case 202.

FIG. 6 is a perspective view of the rescue device 10 shown in FIGS. 1-5. As shown in FIGS. 3 and 6, the cover 14 is of clam shell type configuration and is in a lowered and open position. More specifically, the cover 14 includes a first portion 86 which defines a periphery 88. The periphery 88 has a first end 90 and a second end 92.

A second portion 94 of the cover 14 defines a further periphery 96. The further periphery 96 has a first extremity 98 and a second extremity 100. The arrangement is such that the first portion 86 and the second portion 94 pivot relative to each other about an axis 102 which extends through the ends 90, 92 and the extremities 98, 100 of the periphery 88 and further periphery 96 respectively. Therefore, in a first disposition of the portions 86, 94, as shown in FIG. 6, placement of the child C within the safe enclosure 16 is permitted as shown in FIG. 1.

However, in a second disposition of the portions 86, 94, as shown in FIG. 3, the portions 86, 94 are pivotted relative to and towards each other about axis 102 as indicated by the arrow 104 as shown in FIG. 6 for enclosing the child C within the safe enclosure 16 so that evacuation of the child C from the life threatening situation is permitted.

Additionally, as shown in FIG. 6, the first portion 86 includes a carry handle 106 which extends from the periphery 88.

Also, as shown in FIG. 3, the second portion 94 includes a further carry handle 108 which extends from the further periphery 96 such that when the portions 86 and 94 are in the second disposition thereof, the carry handles 106 and 108 cooperate with each other as shown in FIG. 3, so that carrying the rescue device 10 is permitted.

As shown in FIGS. 2 and 6, a web suspension 110 is secured to the periphery 88 and the further periphery 96 of the portions 86 and 94. The arrangement is such that when the portions 86 and 94 are in the first disposition thereof as shown in FIG. 6, placement of the child C on the web suspension 110 is permitted. However, when the portions 86 and 94 are pivotted as indicated by the arrows 104 to the second disposition of the portions 86 and 94, as shown in FIGS. 2 and 3, the child C is safely and securely restrained by the web suspension 110 within the safe enclosure 16 for evacuation of the child C from the life threatening situation.

Figure 7:
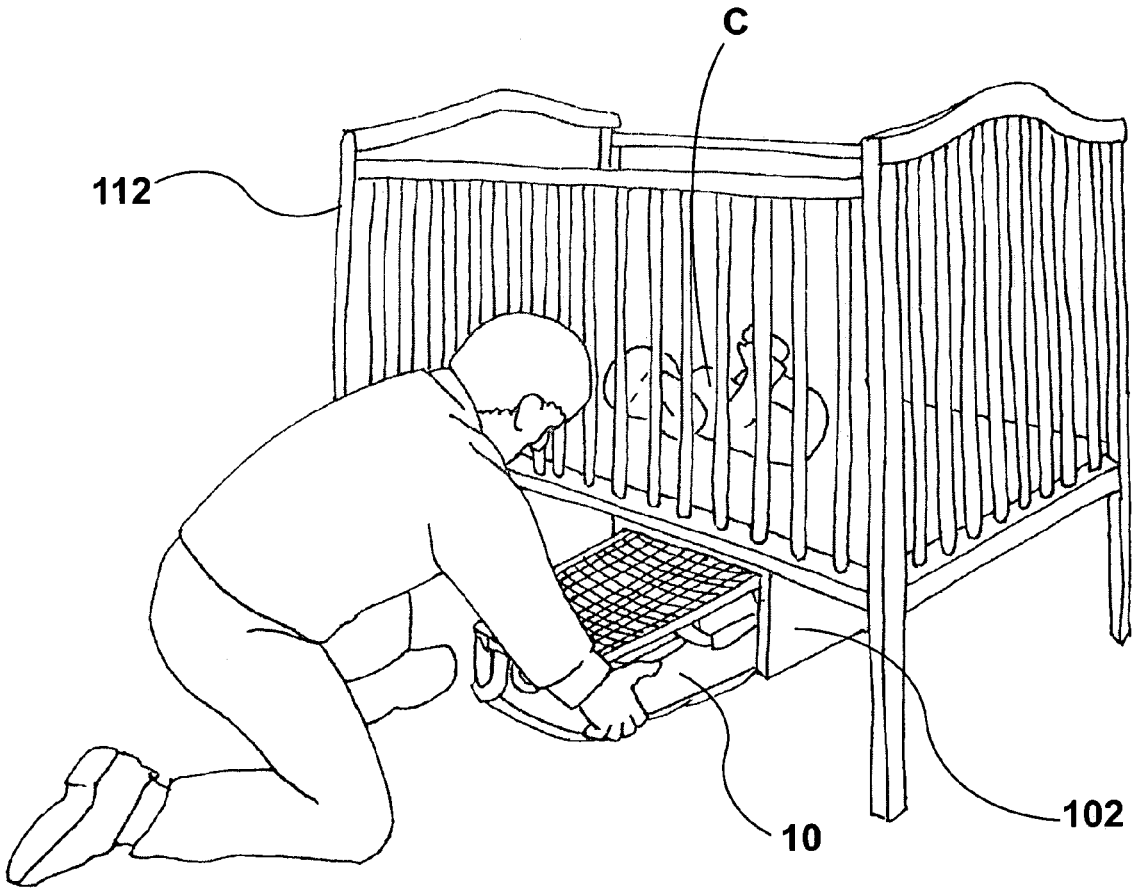
FIG. 7 is a perspective view of the rescue device being removed from its stored location.

FIG. 7 is a perspective view of the rescue device 10 when being removed from its storage unit. As shown in FIG. 7, the rescue device 10 is stored under or adjacent to the child's crib 112 so that the rescue device 10 is readily available for immediate use during the life threatening situation.

Figure 8:
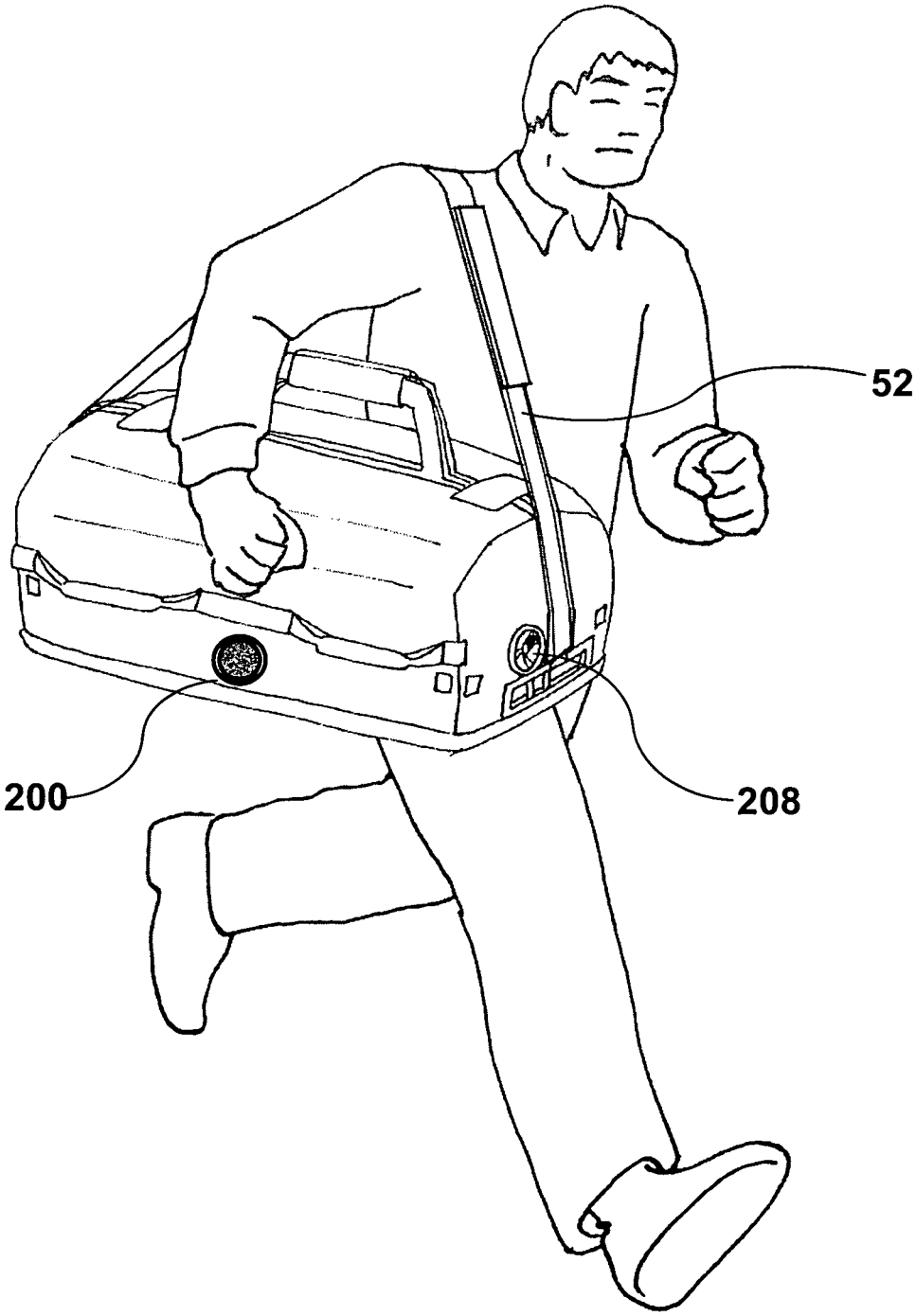
FIG. 8 is a perspective view of the device shown in FIG. 1 being carried in a hands free format.

FIG. 8 is a perspective view of the device 10 shown in FIG. 1. As shown in FIG. 8, the rescuer is running with both hands free and the device 10 carried over the shoulder of the rescuer by means of strap 52.

Figure 9:
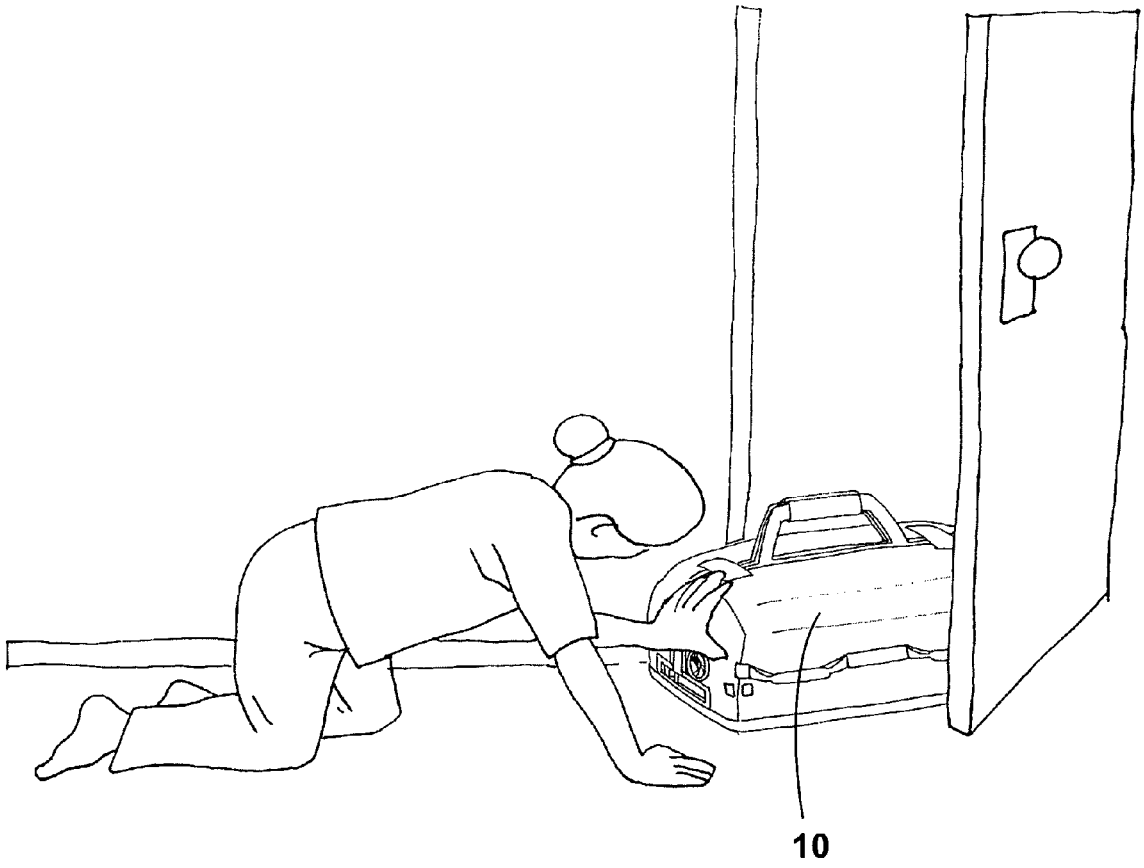
FIG. 9 is a perspective view of the device shown in FIG. 1 being slid on the floor by a rescuer.

FIG. 9 is a perspective view of the device 10 shown in FIG. 1. As shown in FIG. 9, the rescuer is pushing the device 10 with the child therein to safety.

In operation of the rescue device 10, the parent or rescuer takes the rescue device 10 from under the crib 112 and upon removal of the device 10 from its storage unit, the internal lamp 74 for illuminating the safe enclosure 16 activates allowing the accurate visual placements of the child C on the web suspension 110 within the illuminated safe enclosure 16. The handles 106 and 108 are then moved together as indicated by the arrows 104 so that the child C is safely secured within the safe enclosure 16. As the portions 86 and 94 meet, various electrical circuits 64 controlling the exterior flashing strobes 66, the continuous beam light 208 and the audio alarm circuit 62 are automatically activated and energized by the battery 60. Therefore, at the moment the child C is prepared for a rescue, the battery 60 energizes the lamp 74 for illuminating the safe enclosure 16. The battery also energizes the exterior beam flashlights 208. The battery 60 further energizes the audible alarm circuit 64. Additionally, the fan 70 (if included in the construction) is energized so that a filtered flow of air 72 flows into the safe enclosure 16.

The rescuer then carries the rescue device to safety by either lifting the rescue device 10 by the handles, 106 and 108, or by the grips 44 and 45, or by the strap 52. Alternatively, the rescuer may place the shoulder strap 52 over the rescuer's shoulder thus leaving both hands free for completing the rescue operation.

If the emergency situation is upstairs and the stairway is blocked by flames, the rope 78 and belay system 84 are used by the rescuer to controllably lower the rescue device 10 with the child C therein to safety. If the window, as shown in FIG. 5B, does not permit direct lowering of the rescue device 10 to a point of safety, the runners 48 to 50 permit the rescue device 10 to slide controllably over the surface S of a sloping roof. Thereafter, the rescue device 10 can then be lowered to a point of safety on the ground below.

The present invention provides a unique arrangement for safely transporting a child from a hostile environment such as a fire to a point of safety and provides a safer means for rescuing a child from such an emergency.

What is claimed is:

1. A rescue device for rescuing a child from a life threatening situation, said device comprising:

a container for the reception therein of the child; and a cover cooperating with said container such that when the child has been placed within said container, said container and said cover cooperate with each other to define a safe enclosure for the evacuation of the child from the life threatening situation, the container fabricated of a material that is fire resistant and impact resistant so that the child within the device is insulated from hot atmospheric conditions outside the device;

the container including:

a base having an inner and an outer surface, a first and a second end and a first and a second side, said ends and said sides of said base defining a peripheral edge; and a wall having an inner face and an outer face and a first and a second side, said first side of said wall having a first length which is equal to a second length of said peripheral edge of said base, said first side of said wall and said peripheral edge being joined together such that said wall extends away from said base with said second side of said wall being spaced from said base;

the container defining a compartment, with an alarm system housed within said compartment; said alann system including:

a battery; and an audio alarm emmitter operably connected to said battery such that during the evacuation of the child, said audio alarm emmitter provides an audible indication of said rescue device location; and an electrical insulator disposed between said battery and said alarm system such that when said device is dormant, electrical charge is stored within said battery and when said closure cooperates with said container, said insulator is moved from between said battery and said alarm system so that said battery is electrically connected to said alarm system thereby maintaining the electrical charge until needed during the evacuation of the child from the life threatening situation.

2. A rescue device as set forth in claim 1 further including:

a fan energized by said battery for generating a flow of air into said safe enclosure;

a filter disposed within said flow of air for filtering said flow of air flowing into said safe enclosure.

3. A rescue device as set forth in claim 1 further including:

a lamp operably connected to said battery so that when the child is placed within said safe enclosure, such safe enclosure is illuminated by said lamp in order to help the rescuer place the child into the safe enclosure even in total darkness and also to comfort the child during the evacuation of the child from the life threatening situation.

4. A rescue device for rescuing a child from a life threatening situation, said device comprising:

a container for the reception therein of the child; and a cover cooperating with said container such that when the child has been placed within said container, said container and said cover cooperate with each other to define a safe enclosure for the evacuation of the child from the life threatening situation, the container fabricated of a material that is fire resistant and impact resistant so that the child within the device is insulated from hot atmospheric conditions outside the device;

the container including:

a base having an inner and an outer surface, a first and a second end and a first and a second side, said ends and said sides of said base defining a peripheral edge; and a wall having an inner face and an outer face and a first and a second side, said first side of said wall having a first length which is equal to a second length of said peripheral edge of said base, said first side of said wall and said peripheral edge being joined together such that said wall extends away from said base with said second side of said wall being spaced from said base, wherein said container defines a further compartment;

a rope having a first and a second end, said first end of said rope being secured to said container; and a belay system secured to said rope between said first and second ends thereof such that in a first disposition of said rope, said rope and said belay system are stored within said further compartment and in a second disposition of said rope, during the evacuation of the child, said rope and said belay system are removed from said further compartment and said belay system cooperates with said rope for permitting a controlled lowering of said container with the child disposed within said safe enclosure so that the child is lowered from the life threatening situation to a safe location.

5. A rescue device as set forth in claim 4 wherein said container includes:

a plurality of push/pull grips which extend around said wall, said grips being disposed between said sides of said wall such that during the evacuation of the child, said grips permit pushing and pulling of said container when the child is within said safe enclosure.

6. A rescue device as set forth in claim 4 wherein said container includes:

at least one runner is secured to said base such that during the evacuation of the child, said at least one runner permits said container to slide along a surface contacted by said at least one runner to facilitate rapid evacuation of the child from the life threatening situation.

7. A rescue device as set forth in claim 4 wherein said container includes:

an integral fire resistant shoulder carry strap, said carry strap extending from said outer face of said wall so that a rescuer is able to transport the device using less than both of the hands of the rescuer thus permitting the rescuer to open doors and to remove debris which would be difficult operations to perform if the rescuer were using both hands to transport the child.

8. A rescue device as set forth in claim 4 wherein said container defines a compartment;

an alarm system housed within said compartment; said alarm system including:

a battery;

an audio alarm emmitter operably connected to said battery such that during the evacuation of the child, said audio alarm emmitter provides an audible indication of said rescue device location.

9. A rescue device as set forth in claim 4 wherein said container defines a compartment;

an alarm system housed within said compartment;

said alarm system including:

a visual alarm arrangement operably connected to said battery;

a plurality of lights disposed over said outer surface of said base and said outer face of said wall, said lights being operably connected to said visual alarm arrangement such that during the evacuation of the child, said lights provide a visual indication of said rescue device location and provides light for better visual navigation out of the life threatening situation by the rescuer.

10. A rescue device as set forth in claim 4 wherein said cover is of clam shell type configuration.

11. A rescue device as set forth in claim 4 wherein said cover includes:

a first portion which defines a periphery;

said periphery having a first and a second end;

a second portion which defines a further periphery;

said further periphery having a first and a second extremity;

said first and second portions pivoting relative to each other about an axis extending through said ends and said extremities of said periphery and further periphery respectively such that in a first disposition of said portions, placement of the child within said safe enclosure is permitted and in a second disposition of said portions, said portions are pivotted relative to and towards each other for enclosing the child within said safe enclosure so that evacuation of the child from the life threatening situation is permitted.

12. A rescue device as set forth in claim 11 wherein said first portion includes:

a carry handle extending from said periphery;

said second portion includes:

a further carry handle extending from said further periphery such that when said portions are in said second disposition thereof, said carry handles cooperate with each other so that carrying said rescue device by said carry handles is permitted.

13. A rescue device as set forth in claim 11 further including:

a web suspension secured to said periphery and said further periphery of said portions such that when said portions are in said first disposition thereof, placement of the child on said web suspension is permitted and when said portions are pivotted to said second disposition of said portions, the child is safely and securely restrained within said safe enclosure during evacuation of the child from the life threatening situation.

14. A rescue device as set forth in claim 4 further including:

a web suspension disposed within said safe enclosure so that the child is safely and securely restrained within said safe enclosure during evacuation of the child from the life threatening situation and so that said web suspension absorbs any shocks that would otherwise injure the child.

15. A rescue device as set forth in claim 4 wherein said rescue device is stored under or adjacent to the baby's crib so that said rescue device is readily available for immediate use during the life threatening situation.

16. A rescue device as set forth in claim 4 wherein said safe enclosure contains sufficient air during a rescue operation to sustain the child and so that integrity of air within said safe enclosure is maintained despite a smoke filled environment outside said safe enclosure.

17. A rescue device for rescuing a child from a life threatening situation, said device comprising:

a container for the reception therein of the child;

a cover cooperating with said container such that when the child has been placed within said container, said container and said cover cooperate together to define a safe enclosure for the evacuation of the child from the life threatening situation;

said container being fabricated from a material which is fire resistant and impact resistant;

said container including:

a base having an inner and an outer surface, a first and a second end and a first and a second side, said ends and said sides of said base defining a peripheral edge;

a wall having an inner face and an outer face and a first and a second side, said first side of said wall having a first length which is equal to a second length of said peripheral edge, said first side of said wall and said peripheral edge being joined together such that said wall extends away from said base with said second side of said wall being spaced from said base;

a plurality of push/pull grips which extend around said wall, said grips being disposed between said sides of said wall such that during the evacuation of the child, said grips permit pushing and pulling of said container when the child is within said safe enclosure;

a plurality of runners secured to said base such that during the evacuation of the child, said runners permit said container to scovere along a surface contacted by said runners to facilitate rapid evacuation of the child from the life threatening situation;

an integral fire resistant shoulder carry strap;

said container defining a compartment;

an alarm system housed within said compartment;

said alarm system including:

a battery;

an audio alarm emmitter operably connected to said battery such that during the evacuation of the child, said audio alarm emmitter provides an audible indication of said rescue device location;

a visual alarm arrangement operably connected to said battery;

a plurality of lights disposed over said outer surface of said base and said outer face of said wall, said lights being operably connected to said visual alarm arrangement such that during the evacuation of the child, said lights provide a visual indication of said rescue device location as well as creating a light source for helping the rescuer navigate from the life threatening situation;

a lamp operably connected to said battery so that when the child is placed within said safe enclosure, such safe enclosure is illuminated by said lamp in order to aid in the placement of the child in dark conditions as well as comfort the child during the evacuation of the child from the life threatening situation;

said container defines a further compartment;

a rope having a first and a second end, said first end of said rope being secured to said container;

a belay system secured to said rope between said first and second ends thereof such that in a first disposition of said rope, said rope and said belay system are stored within said further compartment and in a second disposition of said rope, during the evacuation of the child, said rope and said belay system are removed from said further compartment and said belay system cooperates with said rope for permitting a controlled lowering of said container with the child disposed within said enclosure so that the child is lowered from the life threatening situation to a safe location;

said cover including a first portion which defines a periphery;

said periphery having a first and a second end; a second portion which defines a further periphery;

said further periphery having a first and a second extremity;

said first and second portions pivoting relative to each other about an axis extending through said ends and said extremities of said periphery and further periphery respectively such that in a first disposition of said portions, placement of the child within said safe enclosure is permitted and in a second disposition of said portions, said portions are pivotted relative to and towards each other for enclosing the child within said safe enclosure so that evacuation of the child from the life threatening situation is permitted; said first portion including: a carry handle extending from said periphery;

said second portion includes:

a further carry handle extending from said further periphery such that when said portions are in said second disposition thereof, said carry handles cooperate with each other so that carrying said rescue device is permitted; and a web suspension secured to said periphery and said further periphery of said portions such that when said portions are in said first disposition thereof, placement of the child on said web suspension is permitted and when said portions are pivotted to said second disposition of said portions, the child is safely and securely restrained within said safe enclosure during evacuation of the child from the life threatening situation.

* * * * *